US011542709B2

(12) United States Patent
Danna et al.

(10) Patent No.: US 11,542,709 B2
(45) Date of Patent: Jan. 3, 2023

(54) PROTECTIVE CAP FOR REINFORCEMENT BARS

(71) Applicant: JD RUSSELL COMPANY, Utica, MI (US)

(72) Inventors: Nicholas Danna, Tucson, AZ (US); Bradley Danna, Shelby Township, MI (US); Charles Snooks, Shelby Township, MI (US)

(73) Assignee: JD RUSSELL COMPANY, Utica, MI (US)

( * ) Notice: Subject to any disclaimer, the term of this patent is extended or adjusted under 35 U.S.C. 154(b) by 33 days.

(21) Appl. No.: 17/142,628

(22) Filed: Jan. 6, 2021

(65) Prior Publication Data

US 2021/0207377 A1 Jul. 8, 2021

Related U.S. Application Data

(60) Provisional application No. 62/957,459, filed on Jan. 6, 2020.

(51) Int. Cl.
*E04C 5/16* (2006.01)

(52) U.S. Cl.
CPC ..... *E04C 5/161* (2013.01); *Y10S 206/82* (2013.01)

(58) Field of Classification Search
CPC ..... E04C 5/161; Y10T 428/15; Y10T 403/11; Y10S 206/82
See application file for complete search history.

(56) References Cited

U.S. PATENT DOCUMENTS 3,869,778 A * 3/1975 Yancey ..... B21D 47/00 428/573
3,892,902 A * 7/1975 Ilukowicz ..... B65D 57/006 206/820
4,202,378 A * 5/1980 Bush ..... E04G 21/32 138/96 R
4,586,609 A * 5/1986 Won ..... G09F 3/14 206/343
4,709,519 A * 12/1987 Liefer ..... B65D 88/72 52/480
4,799,590 A * 1/1989 Furman ..... B65D 1/30 206/390
4,801,064 A * 1/1989 Mangone, Jr. ..... F16L 3/04 227/120
4,817,794 A * 4/1989 Workman ..... E04G 25/00 206/372

(Continued)

FOREIGN PATENT DOCUMENTS

DE 2940522 A1 * 4/1980 ..... F16G 3/08
FR 2753688 A1 3/1998

(Continued)

*Primary Examiner* — Adriana Figueroa
(74) *Attorney, Agent, or Firm* — Carlson, Gaskey & Olds, P.C.

(57) ABSTRACT

An illustrative example embodiment of a protective cap assembly includes a plurality of protective caps each including a stem and a top plate. The top plates each have a plurality of edges. One of the edges of a first one of the protective caps is connected to an adjacent edge of a second one of the caps in a manner that allows for manually separating the first or second one of the protective caps from the assembly.

15 Claims, 6 Drawing Sheets

(56) References Cited

U.S. PATENT DOCUMENTS 4,875,620 A * 10/1989 Lane, Sr. ..... B65D 1/26 229/404
4,966,296 A * 10/1990 Farrell ..... A47G 23/06 206/820
5,313,757 A 5/1994 Schnepf
5,363,618 A 11/1994 Underwood
5,615,523 A * 4/1997 Wells ..... E04D 1/265 52/309.1
5,850,935 A * 12/1998 Luburic ..... B65D 77/0413 220/675
5,931,622 A * 8/1999 Gupta ..... F16B 27/00 411/443
6,073,415 A 6/2000 Carnicle
6,155,004 A * 12/2000 Earhart ..... E04F 13/0853 52/217
6,662,514 B2 * 12/2003 Workman ..... E04C 5/02 256/DIG. 6
D522,857 S * 6/2006 Tabeshnekoo ..... D9/435
7,207,095 B2 * 4/2007 Bruins ..... F16B 15/08 206/343
7,654,389 B2 * 2/2010 Vogrig ..... B21J 15/323 206/338
7,716,898 B1 * 5/2010 Dunn ..... E04G 21/3252 52/689
8,642,150 B2 * 2/2014 Connell ..... E04G 25/00 428/43
9,021,758 B2 * 5/2015 Kassarjian ..... E04C 5/161 52/301
D742,730 S * 11/2015 Vandenberg ..... D8/382
2003/0140574 A1 * 7/2003 Mothes ..... B28B 7/0085 52/98
2003/0141218 A1 * 7/2003 Stephens ..... B65D 81/3453 206/484
2004/0088928 A1 * 5/2004 Headrick, II ..... E04D 13/176 454/365
2009/0050664 A1 * 2/2009 Henza ..... F16B 43/00 227/16
2009/0107067 A1 * 4/2009 Beery ..... E04G 21/32 52/301
2009/0180828 A1 * 7/2009 Weaver ..... E04C 5/165 403/268
2013/0019537 A1 1/2013 Falcone
2016/0208491 A1 7/2016 Green et al.
2019/0242132 A1 8/2019 Beaver et al.

FOREIGN PATENT DOCUMENTS

FR 3011018 B1 3/2015
JP 2003343039 A 12/2003

* cited by examiner

PROTECTIVE CAP FOR REINFORCEMENT BARS

BACKGROUND

Concrete has proven to be a useful building material. Many concrete structures include reinforcing bars or rebar to add strength and stability to the structure. For example, concrete roads typically include a mesh of rebar. Vertically extending structures, such as walls, often include vertically oriented reinforcing bars. There are times during the construction process when such bars are exposed. For example, rebar may extend upward from a footing prior to the placement or construction of a wall that is eventually supported on the footing.

Protective caps for reinforcing bars are known. The caps provide a wider surface at the top of the exposed bars to protect an individual from injury that otherwise might result from accidental contact with the top or edge of the bar. Placing protective caps on a significant number of exposed bars at a jobsite can be a lengthy process because it is awkward or difficult to carry more than one or two caps in each hand.

SUMMARY

An illustrative example embodiment of a protective cap assembly includes a plurality of protective caps each including a stem and a top plate. The top plates each have a plurality of edges. One of the edges of a first one of the protective caps is connected to an adjacent edge of a second one of the caps in a manner that allows for manually separating the first or second one of the protective caps from the assembly.

An illustrative example embodiment of a method of packaging a plurality of protective caps for reinforcing bars includes connecting top plates of the protective caps by establishing a connection between one of the edges of a first one of the protective caps and an adjacent edge of a second one of the protective caps. The connection allows for manually separating the first or second one of the protective caps from the assembly.

The various features and advantages of the present disclosure will become apparent to those skilled in the art from the following detailed description. The drawings that accompany the detailed description can be briefly described as follows.

DETAILED DESCRIPTION

Figure 1:
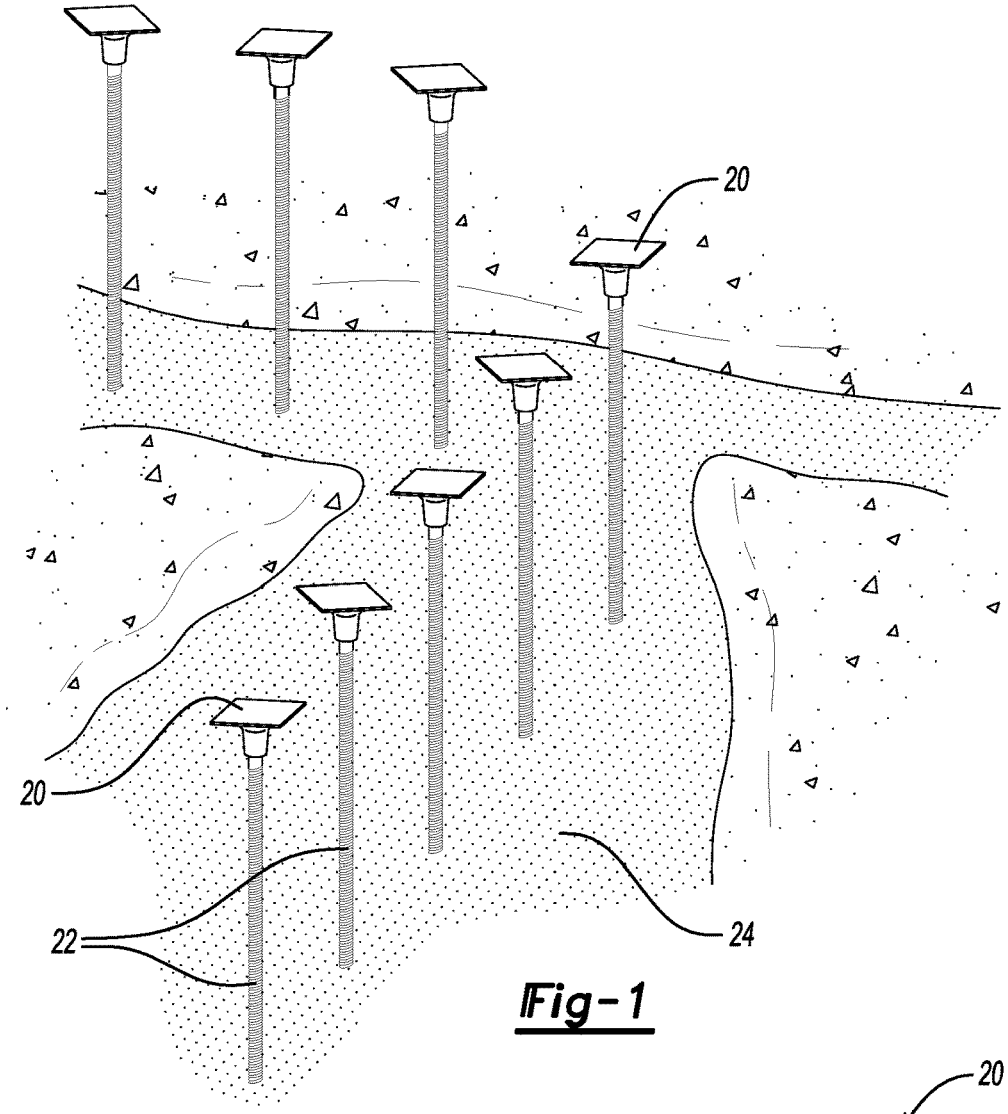
FIG. 1 illustrates a plurality of protective caps on reinforcing bars.

FIG. 1 illustrates a plurality of protective caps 20 situated on reinforcing bars 22 that extend upward from a concrete footing 24. The reinforcing bars 22 will be used for reinforcing or stabilizing a wall structure (not illustrated) that will be supported on the concrete footing 24. Until the wall structure is installed, the protective caps 20 prevent undesired contact with the ends of the reinforcing bars 22. The protective caps 20 can be removed from the reinforcing bars 22 during the process of constructing or installing the wall structure.

Figure 2:
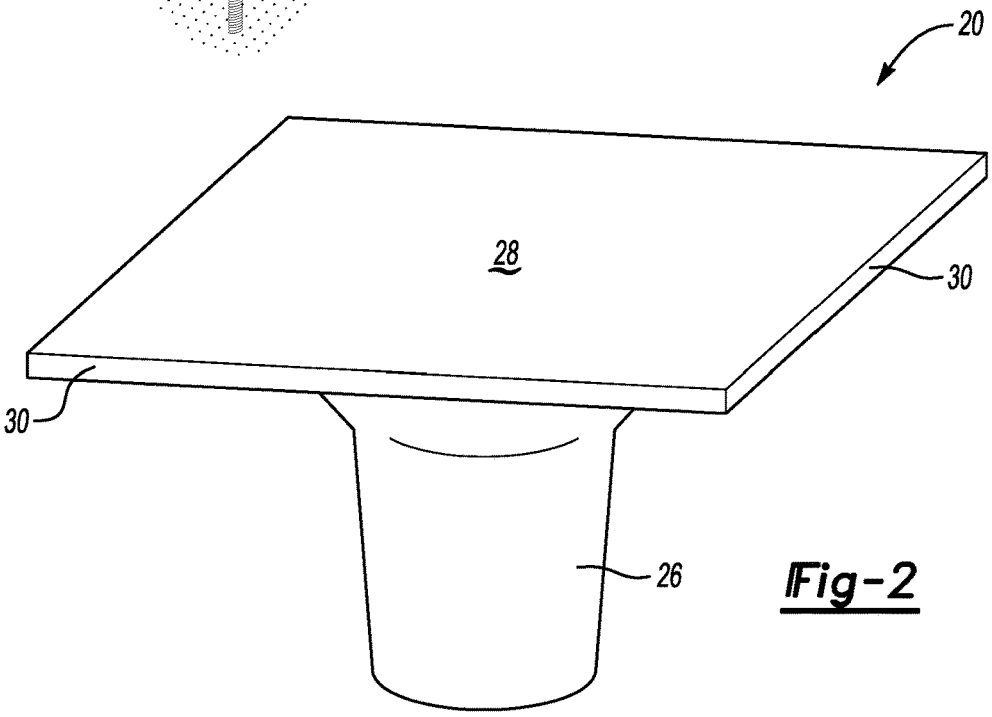
FIG. 2 illustrates an example protective cap.

FIG. 2 shows an example configuration of a protective cap 20. A stem 26 is hollow or includes a recess so that the stem 26 fits over the end of a reinforcing bar 22. In the illustrated example, the stem 26 comprises a cylinder that fits over an end of a reinforcing bar 22. A top plate 28 provides a larger surface area at the top of a reinforcing bar 22 when the cap 20 is situated on the bar. The top plate 28 in this example is generally square and has straight edges 30. Although not specifically illustrated, some embodiments include a steel insert, such as a plate or cup, beneath the top plate 28. Such steel inserts are useful in situations in which OSHA approval is desired or needed, for example.

Figure 3A:
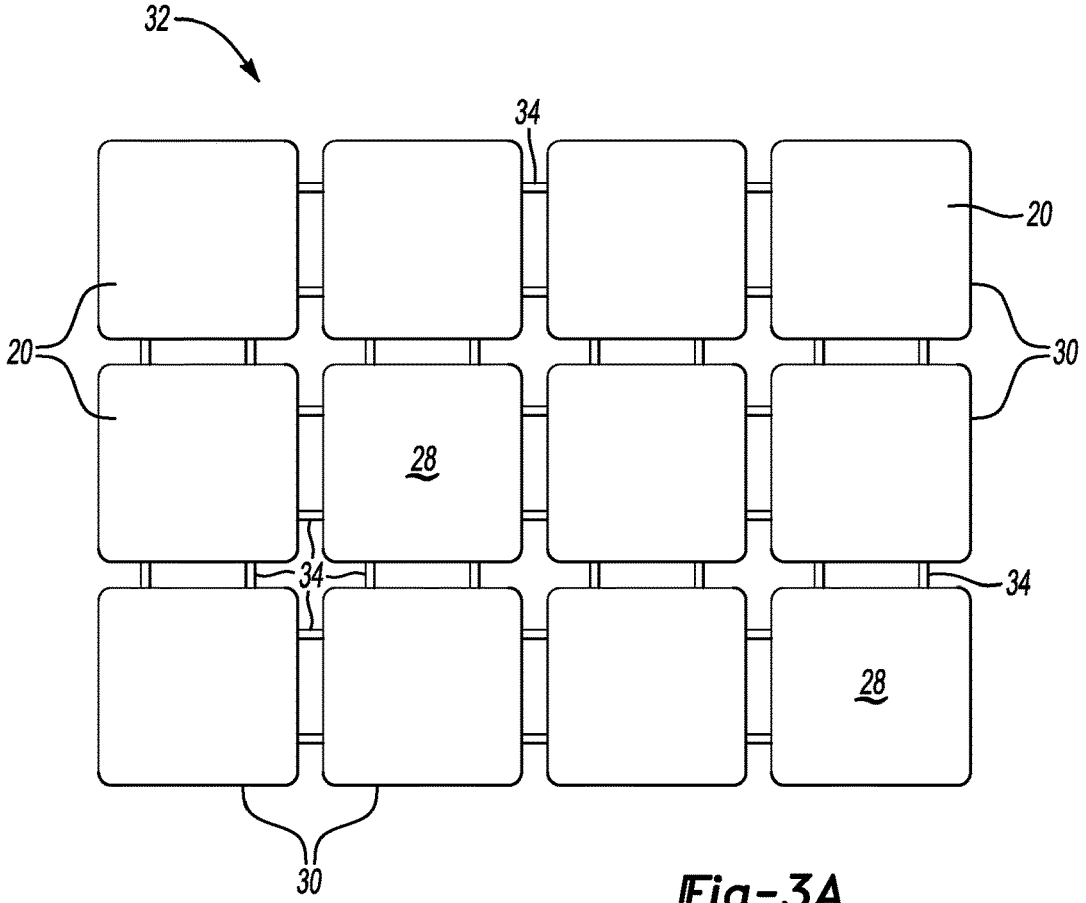
FIG. 3A illustrates an example assembly of protective caps including an example embodiment of frangible connectors between adjacent caps.

FIG. 3A illustrates an example assembly 32 of protective caps 20. Connectors 34 extend between adjacent edges 30 of the top plates 28 and connect the caps 20 together. The connectors 34 in some embodiments are formed while molding the caps 20. In the illustrated embodiment, the connectors 34 or the interface between the connector 34 and a corresponding edge 30 is frangible so that the connection between two adjacent caps 20 can be broken to separate the caps 20 from each other.

In this example embodiment, the connectors 34 each have a length between the adjacent or oppositely facing edges of the corresponding top plates 28. Each connector has a first thickness along most of its length including the central or middle portion of the connector 34. The ends of the connector 34 near the edges 30 of the corresponding top plates 28 include a second, smaller thickness. The smaller thickness near the ends provides a frangible portion of the connector or a frangible interface between the connector 34 and the corresponding edge 30 of the top plate 28.

The frangible connectors 34 allow an individual to carry the assembly 32 including multiple caps 20 around a jobsite and break off one of the caps 20 when needed to place that cap on a reinforcing bar. The assembly 32 simplifies the task of carrying and setting multiple caps 20 making the job easier and more efficient.

Figure 3B:
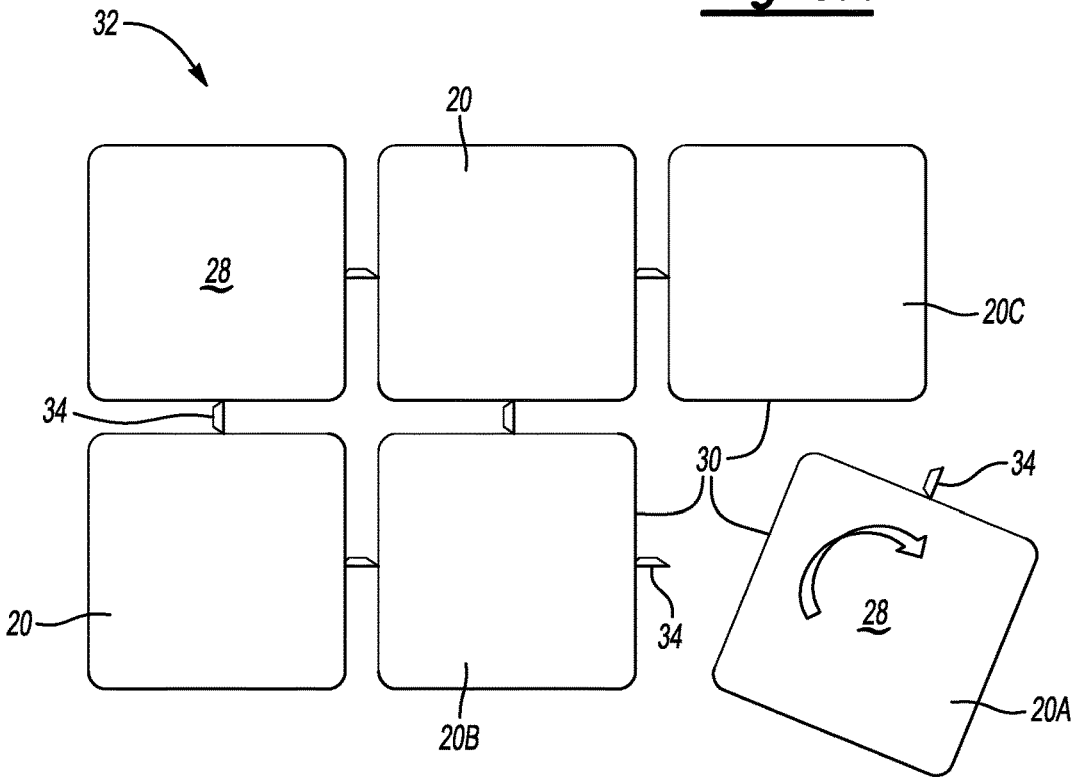
FIG. 3B illustrates another example assembly of protective caps including another example embodiment of frangible connectors between adjacent caps.

The example assembly 32 shown in FIG. 3B includes one connector 34 extending between each set of adjacent edges 30. As shown in FIG. 3B, one of the caps 20A has been separated from the assembly 32 by breaking away the connection between the connectors 34 that extend from two of the edges 30 of the cap 20A and the caps 20B and 20C whose edges 30 were adjacent to those edges 30 of the cap 20A.

Other embodiments include a different number of connectors 34, such as three, between each set of adjacent edges 30. An increased number of connectors 34 increases the strength of the connections holding the assembly 32 together without making it too difficult to separate one of the caps 20 as needed.

The example assemblies 32 in FIGS. 3A and 3B include connectors 34 that resemble pins or posts. Other embodiments include connectors 34 that resemble a web or lattice extending along a substantial portion of the interface between two adjacent edges 30. In such embodiments the web-like connectors 34 are manually breakable to separate the caps 20 from each other as needed.

Figure 4:
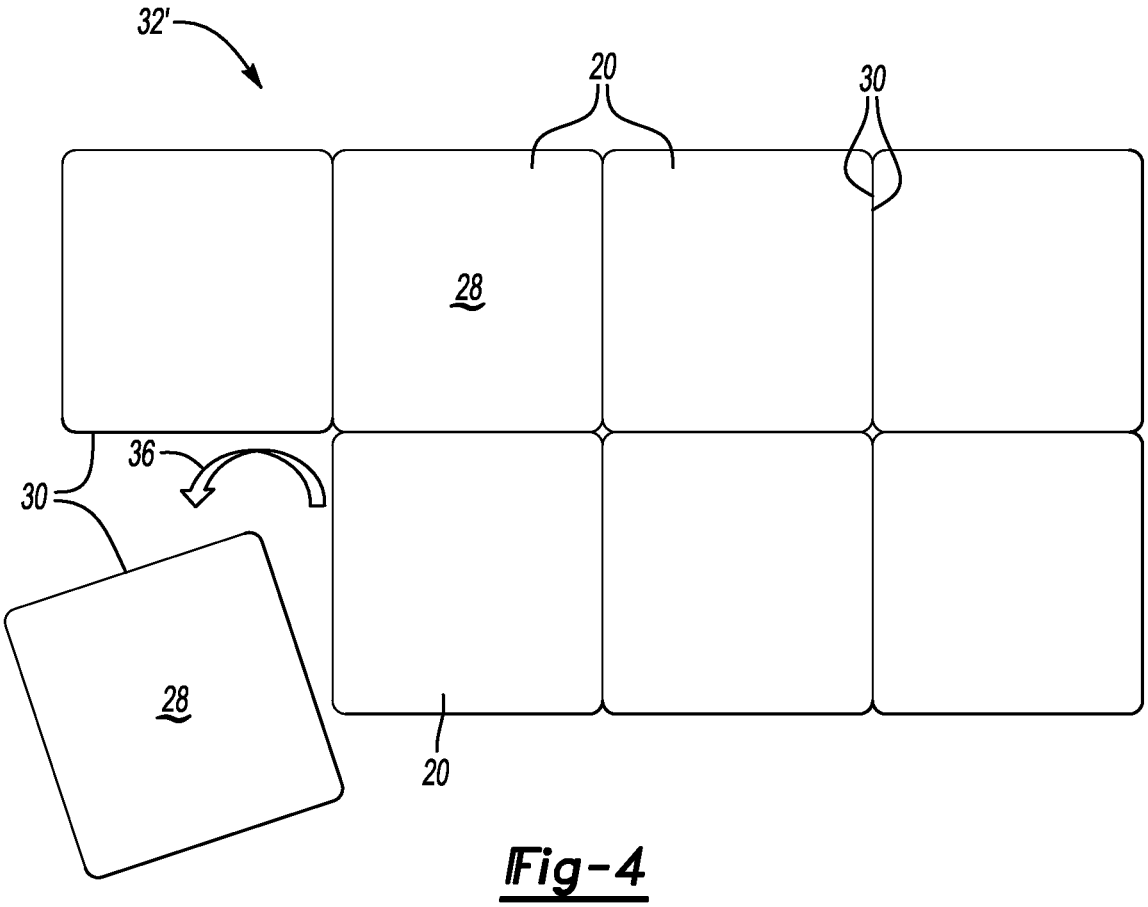
FIG. 4 illustrates an example assembly of caps including an example embodiment of another type of connector between adjacent caps.

FIG. 4 illustrates another assembly 32' of a plurality of protective caps 20. In this example embodiment, the edges 30 include connection features that allow the top plates 28 to be selectively coupled together and separated from each other. For example, a cap 20A has been pulled away from the assembly as schematically shown by the arrow 36. That cap 20A may be placed on a reinforcing bar and the rest of the assembly 32' can be carried to the location of the next bar to be covered. The cap 20A also may be reattached to the assembly 32'.

Figure 5:
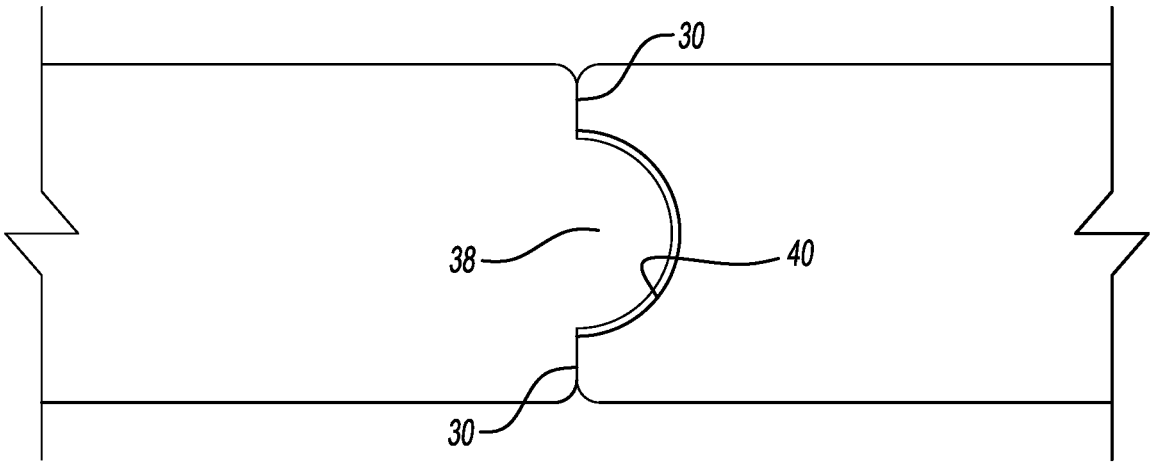
FIG. 5 schematically illustrates a connection feature of the embodiment of FIG. 4.

As shown in FIG. 5, some embodiments include snap-together connection features such as ribs 38 on one of the edges 30 and channels 40 on other edges 30 that allow top plates 28 to be snapped together and joined into an assembly 32'. The example edge connection features 38, 40 allow an individual at a jobsite to join a desired number of caps in an assembly 32' and carry them around a jobsite to install the caps 20 on reinforcing bars 22. The same features allow an individual to retrieve caps 20 from a jobsite and collect them for reuse by snapping or otherwise coupling the caps together for easier carrying.

Figure 6:
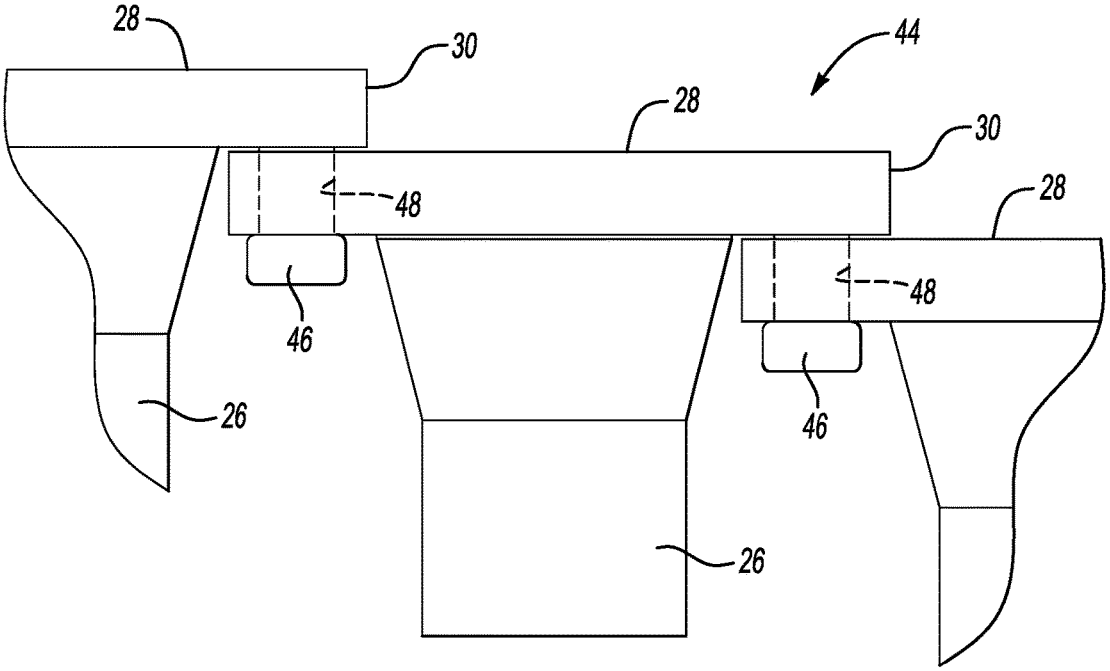
FIG. 6 schematically illustrates another example connection feature.

FIG. 6 shows another example assembly 44 of caps 20. In this example, each top plate 28 includes at least one connection member 46 extending in a direction generally perpendicular to a plane of the top plate 28 and at least one hole or opening 48 in the top plate 28. In the illustrated embodiment, the hole or opening 48 extends through the top plate 28 but in other embodiments, the hole or opening 48 is a blind hole or recess extending into but not through the top plate 28. The connection members 46 in this embodiment are posts or pins. Other configurations of a connection member are included in other embodiments.

The number of connection members 46 and holes or openings 48 may vary. Some embodiments include two connection members 46 near two of the edges 30 of the top plate 28 and two holes 48 near two others of the edges 30. The connection members 46 can be selectively inserted into or removed from the hole or opening 48 of another cap 20 to selectively connect a desired number of caps 20 together or to remove a cap 20 from the assembly 44.

Figure 7:
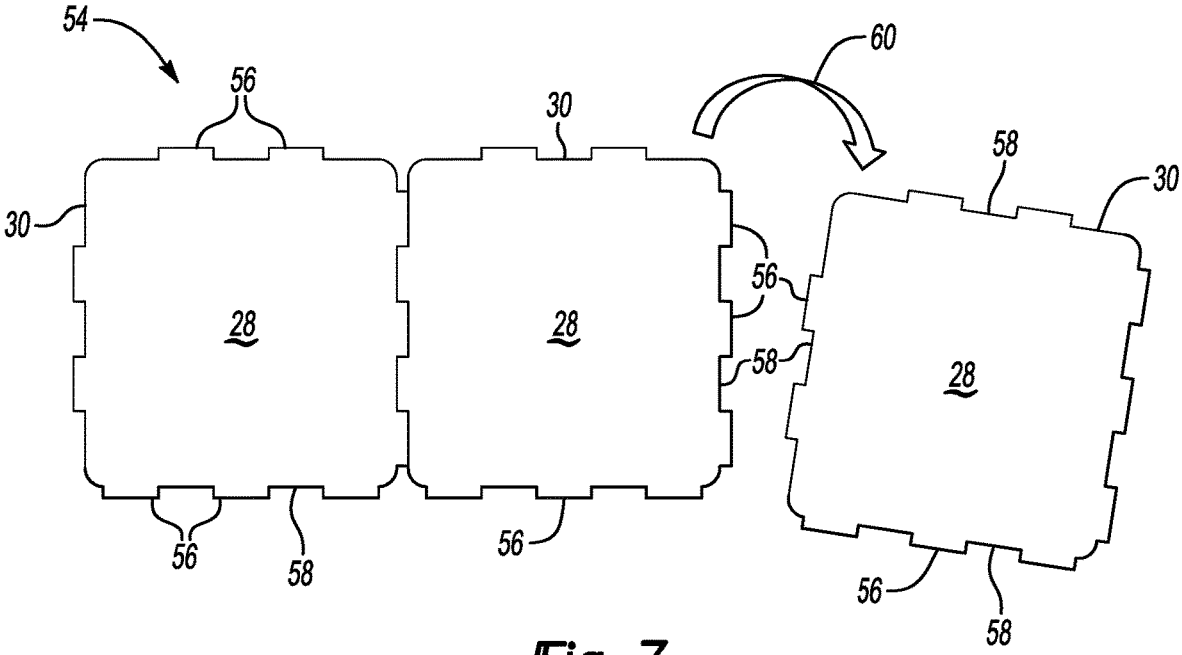
FIG. 7 schematically illustrates another example connection feature.

FIG. 7 shows another example assembly 54 including multiple caps 20 that are selectively connected together. In this embodiment, the edges 30 include tabs 56 and recesses 58 that are configured to nest together in a manner that holds adjacent edges 30 next to each other. The tabs 56 and recesses 58 are connection features that allow for snapping caps 20 together or separating a desired number of caps 20 from the assembly 54. In FIG. 7 the cap 20 shown on the right side has been separated from the assembly 54 by manually manipulating the cap 20 in a manner schematically represented by the arrow 60.

Figure 8:
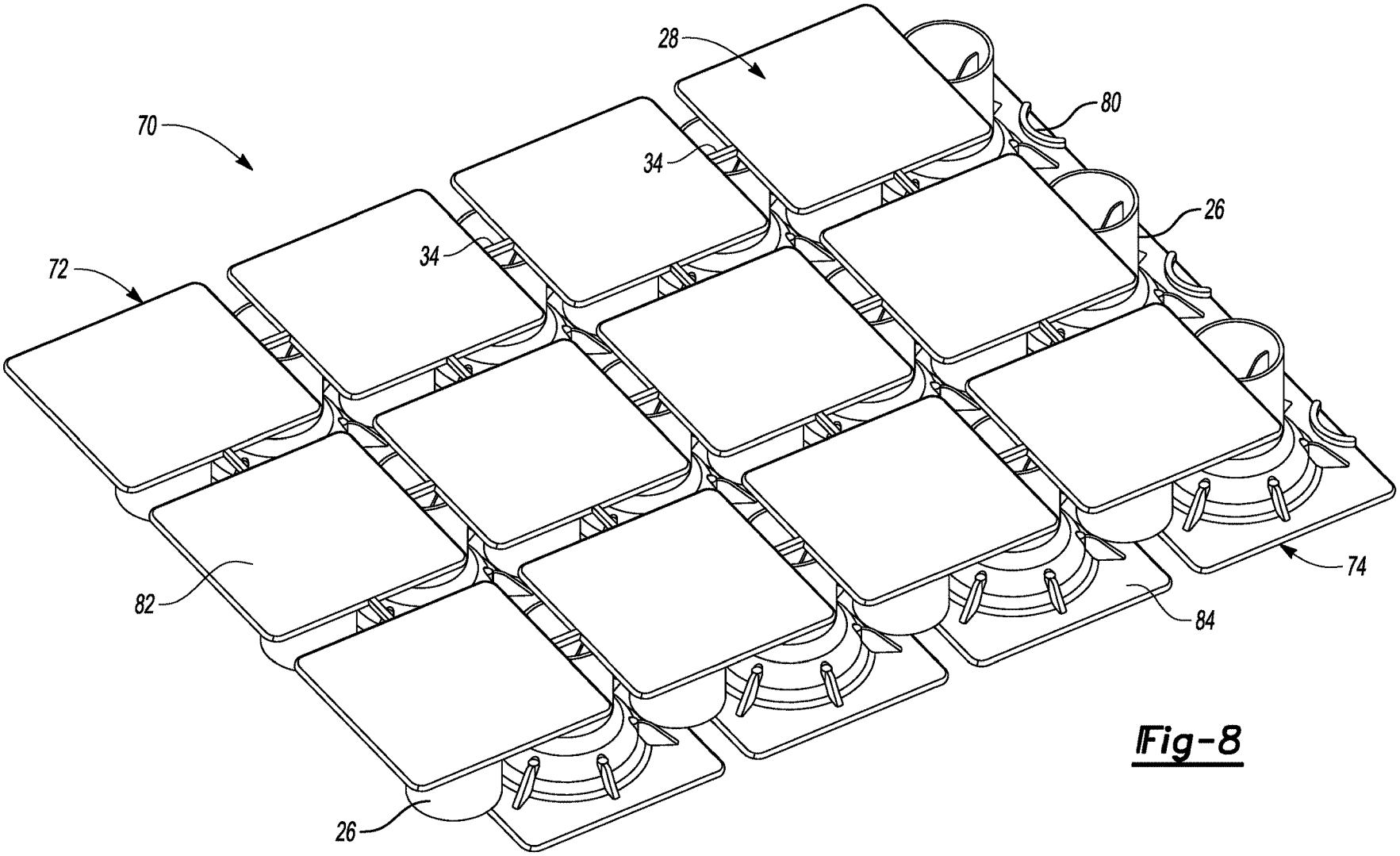
FIG. 8 illustrates an example assembly of protective caps including a first array and a second array facing in opposite directions.

FIG. 8 shows an assembly 70 that includes a first array 72 and a second array 74 of protective caps 20. Each of the arrays 72, 74 in this example include multiple rows and columns of protective caps 20. The stems 26 are in an alternating, nested arrangement between the top plates 28 of the first array 72 and the second array 74.

Figure 9:
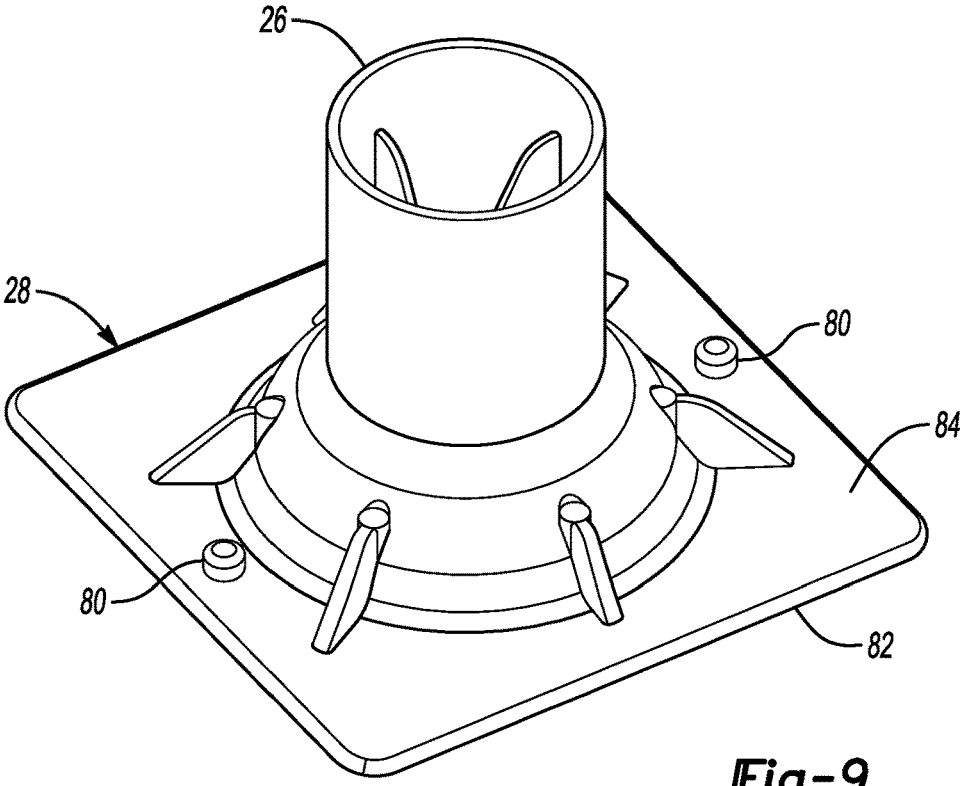
FIG. 9 illustrates a retaining feature of an example embodiment.
Figure 10:
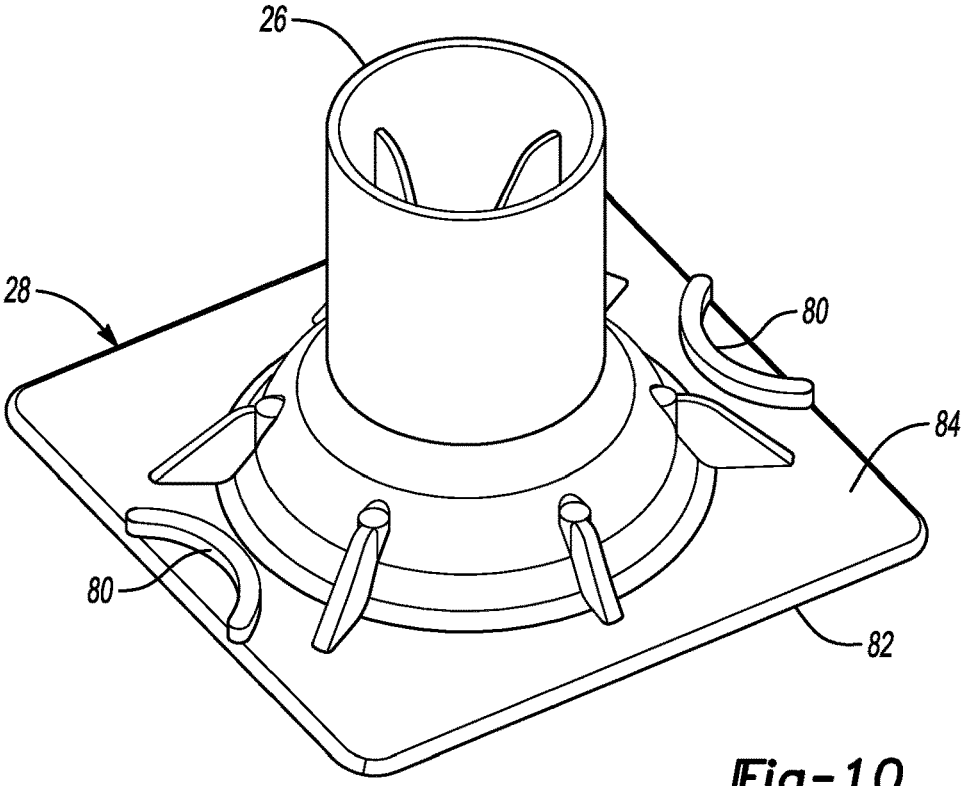
FIG. 10 illustrates another retaining feature configuration.

FIGS. 9 and 10 respectively show example retaining features 80 on the protective caps 20. The top plates 28 each have a first side 82 that faces outwardly when the assembly 70 is arranged as shown in FIG. 8 and a second side 84 that faces toward the other array of the assembly 70. The second side 84 includes retaining features 80 that are configured to engage the stem 26 of another one of the protective caps 20, which is part of the other array in the example of FIG. 8.

Each retaining feature 80 is situated on the second side 84 so that a spacing between the retaining features 80 of adjacent top plates 28 in the same array 72, 74 corresponds to a dimension of the stems 26 that facilitates retaining the stems 26 of one of the arrays 72, 74 in a desired alignment with the other array 74, 72. The spacing between the retaining features 80 is also dictated or established by the way in which adjacent top plates 28 are connected. For example, the length of the connectors 34 in the illustrated embodiment and the position of the retaining features 80 on the second side 84 of the top plate 28 establishes a distance between the retaining features 80 near adjacent edges 30 of adjacent protective caps in an array 72, 74. The spacing among retaining features 80 is timed to correspond with the spacing among the stems 26 of the other array.

In the example of FIG. 8, the distance between the retaining features 80 of adjacent top plates 28 corresponds to an inside diameter of the stems 26 so that the stems 26 of one of the arrays 72, 74 are received over retaining features 80 of the other one of the arrays 72, 74 in the condition shown in FIG. 8. The retaining features 80 prevent movement of the corresponding stem 26 in at least one direction parallel to the top plates 28. In some embodiments, the fit of the retaining features 80 with the stems 26 prevents any lateral movement in at least two directions relative to the top plates of the other array 72, 74.

Since the protective caps 20 of each array 72, 74 are connected in a way that maintains the illustrated array configuration, the retaining features 80 also serve to maintain a desired position of the arrays 72, 74 relative to each other. Maintaining the desired positions of the protective caps 20 is useful when packaging the arrays 72, 74. For example, shrink wrapping the assembly 70 results in a compact and stable arrangement of a selected number, such as twenty-four, protective caps 20. The retaining features 80 and the arrangement of the illustrated assembly 70 is also stable when placed in a box or another container having an appropriate size. Whether wrapped or packaged, a selected number of assemblies 70 can be shipped to customers or transported to job sites by customers.

In some embodiments, the fit between the retaining features 80 and the stems 26 is tight enough to resist movement of the stem 26 in a third direction perpendicular to the top plates 28. In such embodiments, there is a snug fit resembling a snap-fit between the arrays 72, 74 in the condition shown in FIG. 8.

The retaining features 80 in the example embodiment of FIG. 9 are bosses or nubs on the second side 84. FIG. 10 shows another type of retaining feature 80, which is also shown in FIG. 8. In this example, the retaining features include arched or curved surfaces that are configured to engage the stem 26 of another protective cap 20. The retaining features 80 in this embodiment may be spaced apart to fit within the inside diameter of a corresponding stem 26 or to be received adjacent the outside diameter of the stem 26. The retaining features 80 in this embodiment may prevent relative movement of the stems 26 of one of the arrays 72, 74 and the top plates 28 of the other array 74, 72 in at least two directions parallel to the top plates 28. In some embodiments, the retaining features also provide a gripping force that tends to resist, but not prevent, movement of the stems 26 in a third direction perpendicular to the top plates 28. Such a gripping force can hold the two arrays 72, 74 in the arrangement shown in FIG. 8 under at least some conditions.

The retaining features 80 may be realized through a raised surface or ridge. Alternatively, the retaining features 80 are recesses or grooves on the second side 84 into which corresponding portions of a stem 26 are received when the arrays 72, 74 are positioned as shown in FIG. 8.

Embodiments of protective cap assemblies consistent with this description make packaging, shipping and carrying a plurality of protective caps 20 easier and more efficient including the process of installing the caps on rebar at a jobsite. The illustrated and described features are not necessarily limited to the embodiments that are shown. For example, a feature of one embodiment may be combined with features of another embodiment to realize other embodiments.

The preceding description is exemplary rather than limiting in nature. Variations and modifications to the disclosed examples may become apparent to those skilled in the art that do not necessarily depart from the essence of this invention.

We claim:

1. A protective cap assembly comprising:

a plurality of protective caps each including a stem and a top plate, the top plates each having a plurality of edges, wherein one of the edges of a first one of the protective caps is connected to an adjacent edge of a second one of the caps in a manner that allows for manually separating the first or second one of the protective caps from the assembly; and at least one frangible connector extending between the one of the edges and the adjacent edge, wherein the at least one frangible connector includes a first end near the one of the edges of the first one of the protective caps;

a second end near the adjacent edge of the second one of the protective caps;

a first thickness near a center of the connector; and a second, reduced thickness near each of the first end and the second end.

2. The protective cap assembly of claim 1, wherein the at least one frangible connector comprises at least two frangible connectors between the one of the edges and the adjacent edge.

3. The protective cap assembly of claim 1, wherein the plurality of protective caps are arranged in a array including a plurality of rows and a plurality of columns with the at least one frangible connector extending between each set of oppositely facing, adjacent edges on the top plates of the protective caps.

4. A protective cap assembly comprising:

a plurality of protective caps each including a stem and a top plate, the top plates each having a plurality of edges, wherein one of the edges of a first one of the protective caps is connected to an adjacent edge of a second one of the protective caps in a manner that allows for manually separating the first or second one of the protective caps from the assembly, wherein the top plates respectively include at least one connection feature that allows for selectively connecting the first one of the protective caps to the second one of the protective caps.

5. The protective cap assembly of claim 4, wherein the connection feature of one of the edges includes at least one rib or tab and the connection feature on the other of the edges includes a channel or recess configured to at least partially receive the rib or tab for at least temporarily coupling the first one of the caps to the second one of the caps.

6. The protective cap assembly of claim 4, wherein the at least one connection feature on the first one of the protective caps comprises a connection member extending from the top plate of the first one of the protective caps and the at least one connection feature on the second one of the protective caps comprises a hole that receives at least a portion of the connection member of the first one of the protective caps.

7. A protective cap assembly comprising:

a plurality of protective caps each including a stem and a top plate, the top plates each having a plurality of edges, wherein one of the edges of a first one of the protective caps is connected to an adjacent edge of a second one of the caps in a manner that allows for manually separating the first or second one of the protective caps from the assembly, wherein the plurality of protective caps includes a first array of protective caps and a second array of protective caps, the top plates of the first array face in a first direction, the top plates of the second array face in a second, opposite direction, the stems of the protective caps are situated between the top plates of the first array and the second array, the stems of the first array alternate with the stems of the second array, each of the top plates has a first side and a second side, each stem extends from the second side of the respective protective cap, and the second side of each top plate in the first array includes a retaining feature configured to engage a stem of one of the protective caps in the second array.

8. The protective cap assembly of claim 7, wherein the retaining feature comprises a boss on the second side.

9. The protective cap assembly of claim 8, wherein the boss comprises an arched rib.

10. The protective cap assembly of claim 7, wherein the first one of the protective caps and the second one of the caps are in the first array, there is a spacing between the one of the edges of the first one of the protective caps and the adjacent edge of the second one of the caps, and the spacing positions the retaining features on the second sides of the corresponding top plates to engage a stem of another one of the protective caps in a manner that prevents movement of the stem relative to the retaining features in at least one direction.

11. The protective cap assembly of claim 10, wherein the retaining features engage the stem in a manner that prevents movement of the stem in two directions.

12. The protective cap assembly of claim 11, wherein the retaining features engage the stem in a manner that resists movement of the stem in a third direction.

13. A method of packaging a plurality of protective caps for reinforcing bars that each include a stem and a top plate, the plurality of protective caps including a first array of protective caps and a second array of protective caps, the method comprising:

connecting the top plates of the protective caps by establishing a connection between one of the edges of a first one of the protective caps and an adjacent edge of a second one of the protective caps, wherein the connection allows for manually separating the first or second one of the protective caps from the assembly;

situating the first array adjacent the second array with the top plates of the first array facing in a first direction, the top plates of the second array facing in a second, opposite direction, and the stems of the protective caps situated between the top plates of the first array and the second array, arranging the first array and the second array such that the stems of the first array alternate with the stems of the second array; and engaging the stems of the second array with retaining features on the top plates of the first array.

14. The method of claim 13, comprising molding the plurality of protective caps and establishing the connection during the molding.

15. The method of claim 14, wherein establishing the connection comprises molding a frangible connector that extends between the one of the edges and the adjacent edge.

* * * * *